US007278480B2

(12) United States Patent
Longfield et al.

(10) Patent No.: US 7,278,480 B2
(45) Date of Patent: Oct. 9, 2007

(54) APPARATUS AND METHOD FOR SENSING DOWNHOLE PARAMETERS

(75) Inventors: Colin Longfield, Houston, TX (US); Yves Barriol, Houston, TX (US); Douglas W. Grant, Austin, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 261 days.

(21) Appl. No.: 10/907,406

(22) Filed: Mar. 31, 2005

(65) Prior Publication Data

US 2006/0219401 A1 Oct. 5, 2006

(51) Int. Cl.
*E21B 17/00* (2006.01)

(52) U.S. Cl. ..... 166/250.11; 340/856.2; 340/856.3; 73/152.46; 166/66

(58) Field of Classification Search ..... 166/254.1, 166/250.11; 340/853.1, 856.3; 73/152.01, 73/152.54–152.59; 324/347
See application file for complete search history.

(56) References Cited

U.S. PATENT DOCUMENTS

| | | | | |
|---|---|---|---|---|
| 2,821,323 | A | 1/1958 | Lee, II | |
| 3,451,583 | A | 6/1969 | Lee, II | |
| 3,825,146 | A | 7/1974 | Hirmann | |
| 4,091,841 | A | 5/1978 | Beneker et al. | |
| 4,113,006 | A | 9/1978 | Clapp | |
| 4,860,581 | A | 8/1989 | Zimmerman et al. | |
| 4,867,333 | A | 9/1989 | Kolp, Jr. et al. | |
| 4,936,139 | A | 6/1990 | Zimmerman et al. | |
| 5,078,294 | A | 1/1992 | Staubli | |
| 5,095,745 | A | 3/1992 | Desbrandes | |
| 5,160,226 | A | 11/1992 | Lee, II | |
| 5,233,866 | A | 8/1993 | Desbrandes | |
| 5,692,565 | A | 12/1997 | MacDougall et al. | |
| 5,779,085 | A | 7/1998 | Havlinek et al. | |
| 6,003,557 | A | 12/1999 | Brelig et al. | |
| 6,070,662 | A * | 6/2000 | Ciglenec et al. | 166/254.1 |
| 6,301,959 | B1 | 10/2001 | Hrametz et al. | |
| 6,408,943 | B1 | 6/2002 | Schultz et al. | |
| 6,426,917 | B1 | 7/2002 | Tabanou et al. | |
| 6,538,576 | B1 | 3/2003 | Schultz et al. | |
| 6,585,045 | B2 | 7/2003 | Lee et al. | |
| 6,609,568 | B2 | 8/2003 | Krueger et al. | |
| 6,708,978 | B2 | 3/2004 | Kagi | |
| 6,719,049 | B2 | 4/2004 | Sherwood et al. | |
| 6,766,854 | B2 * | 7/2004 | Ciglenec et al. | 166/250.11 |

(Continued)

FOREIGN PATENT DOCUMENTS

| | | |
|---|---|---|
| WO | WO01/65066 | 9/2001 |

(Continued)

*Primary Examiner*—Lanna Mai
*Assistant Examiner*—Matthew J. Smith
(74) *Attorney, Agent, or Firm*—Matthias Abrell; Kevin P. McEnaney; Dale V. Gaudier

(57) ABSTRACT

A sensor plug positionable in a perforation extending into a wall of a wellbore penetrating a subterranean formation is provided. The sensor plug includes a plug sleeve disposable in a perforation extending through the wellbore wall, a pin positionable in the plug sleeve a sensor and circuitry. The pin is adapted to expand the plug sleeve as it is advanced therein whereby the plug sleeve seals the perforation. The sensor plug may be deployed into the sidewall of the wellbore by a downhole tool.

26 Claims, 6 Drawing Sheets

U.S. PATENT DOCUMENTS

| | | | |
|---|---|---|---|
| 6,823,945 | B2 | 11/2004 | Eslinger et al. |
| 6,832,515 | B2 | 12/2004 | Follini et al. |
| 2002/0195247 | A1 | 12/2002 | Ciglenec et al. |
| 2003/0043055 | A1 | 3/2003 | Schultz et al. |
| 2003/0094282 | A1 | 5/2003 | Goode et al. |
| 2004/0000433 | A1 | 1/2004 | Hill et al. |
| 2004/0069487 | A1 | 4/2004 | Cook et al. |
| 2004/0182147 | A1 | 9/2004 | Rambow et al. |
| 2004/0238165 | A1 | 12/2004 | Salamitou et al. |
| 2004/0238166 | A1 | 12/2004 | Salamitou et al. |

FOREIGN PATENT DOCUMENTS

| | | |
|---|---|---|
| WO | WO2004/085797 | 10/2004 |
| WO | WO2006005555 | 1/2006 |

* cited by examiner

APPARATUS AND METHOD FOR SENSING DOWNHOLE PARAMETERS

BACKGROUND OF THE INVENTION

1. Field of the Invention

The present invention relates to techniques for determining downhole parameters in a wellbore and/or surrounding formation.

2. Background of the Related Art

Wellbores are drilled to locate and produce hydrocarbons. A string of downhole pipes and tools with a drill bit at an end thereof, commonly known in the art as a drill string, is advanced into the ground to form a wellbore penetrating (or targeted to penetrate) a subsurface formation of interest. As the drill string is advanced, a drilling mud is pumped down through the drill string and out the drill bit to cool the drill bit and carry away cuttings and to control downhole pressure. The drilling mud exiting the drill bit flows back up to the surface via the annulus formed between the drill string and the wellbore wall, and is filtered in a surface pit for recirculation through the drill string. The drilling mud is also used to form a mudcake to line the wellbore.

It is often desirable to perform various evaluations of the formations penetrated by the wellbore during drilling operations, such as during periods when actual drilling has temporarily stopped. In some cases, the drill string may be provided with one or more drilling tools to test and/or sample the surrounding formation. In other cases, the drill string may be removed from the wellbore (called a "trip") and a wireline tool may be deployed into the wellbore to test and/or sample the formation. Various drilling tools and wireline tools, as well as other wellbore tools conveyed on coiled tubing, are also referred to herein simply as "downhole tools." The samples or tests performed by such downhole tools may be used, for example, to locate valuable hydrocarbons and manage the production thereof.

Formation evaluation often requires that fluid from the formation be drawn into a downhole tool for testing and/or sampling. Various devices, such as probes and/or packers, are extended from the downhole tool to isolate a region of the wellbore wall, and thereby establish fluid communication with the formation surrounding the wellbore. Fluid may then be drawn into the downhole tool using the probe and/or packer.

A typical probe employs a body that is extendable from the downhole tool and carries a packer at an outer end thereof for positioning against a sidewall of the wellbore. Such packers are typically configured with one relatively large element that can be deformed easily to contact the uneven wellbore wall (in the case of open hole evaluation), yet retain strength and sufficient integrity to withstand the anticipated differential pressures. These packers may be set in open holes or cased holes. They may be run into the wellbore on various downhole tools.

Another device used to form a seal with the wellbore sidewall is referred to as a dual packer. With a dual packer, two elastomeric rings are radially expanded about a downhole tool to isolate a portion of the wellbore wall therebetween. The rings form a seal with the wellbore wall and permit fluid to be drawn into the downhole tool via the isolated portion of the wellbore.

The mudcake lining the wellbore is often useful in assisting the probe and/or dual packers in making the appropriate seal with the wellbore wall. Once the seal is made, fluid from the formation is drawn into the downhole tool through an inlet therein by lowering the pressure in the downhole tool.

Examples of probes and/or packers used in downhole tools are described in U.S. Pat. Nos. 6,301,959; 4,860,581; 4,936,139; 6,585,045; 6,609,568 and 6,719,049 and U.S. Patent Application No. 2004/0000433. Such devices may be used to perform various sampling and/or testing operations. Examples of so-called 'pretest' techniques used in some such operations are described for example in U.S. Pat. Nos. 6,832,515, 5,095,745 and 5,233,866.

In some cases, it is necessary to penetrate the sidewall of the wellbore and casing and cement (if present). Techniques have been developed to create holes or perforations through the sidewall and reach the surrounding formation. Examples of such techniques are described in U.S. Pat. No. 5,692,565. It is sometimes desirable to close the holes created in the wellbore wall to prevent fluids from flowing into the wellbore. Examples of techniques that use plugs to fill such perforations are described in U.S. Pat. Nos. 6,426,917, 2,821,323, 3,451,583, 4,113,006, 4,867,333, 5,160,226 and 5,779,085. Techniques have also been developed to provide such plugs with sensors to measure downhole parameters as described, for example, in U.S. Pat. No. 6,766,854.

Despite such advances in downhole perforation and plugging, there remains a need for techniques capable of monitoring downhole parameters and/or plugging perforations in a wellbore wall. It is desirable that such a technique utilize a plug insertable into a wellbore wall and having circuitry capable of collecting data and/or communicating information. It is further desirable that such a plug be provided with one or more of the following, among others: a container to protect electronics from the harsh wellbore environment, a plug sleeve adapted to fit snugly in the perforation, electronics packaging positionable in the plug sleeve, operability in a variety of wellbore conditions (such as low permeability formations) and various downhole testing capabilities, such as a pretest.

SUMMARY OF THE INVENTION

In an aspect, the invention relates to a sensor plug positionable in a perforation extending into a wall of a wellbore penetrating a subterranean formation is provided. The sensor plug includes a plug sleeve disposable in a perforation extending through the wellbore wall, a pin positionable in the plug sleeve a sensor and circuitry. The pin is adapted to expand the plug sleeve as it is advanced therein whereby the plug sleeve seals the perforation. In another aspect, the invention relates to a method of sensing downhole parameters of a wellbore penetrating a subterranean formation. The method involves positioning a plug sleeve in a perforation in a sidewall of the wellbore, sealing the perforation by advancing a pin into the plug sleeve and sensing at least one downhole parameter from a sensor positioned in one of the sleeve and the pin.

In another aspect, the invention relates to a communication system for sensing downhole parameters of a wellbore penetrating a subterranean formation. The communication system includes a sensor plug, a downhole tool positionable in the wellbore, the downhole tool adapted to communicate with the sensor plug and a surface unit in communication with the downhole tool. The sensor plug is positionable in a perforation extending into the wall of the wellbore. The sensor plug includes a plug sleeve disposable in a perforation extending through the wellbore wall, a pin positionable in the plug sleeve, a sensor for measuring downhole properties and circuitry operatively connected to the sensor. The pin adapted to expand the plug sleeve as it is advanced therein whereby the plug sleeve seals the perforation.

These and other aspects may be determined from the following detailed description.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
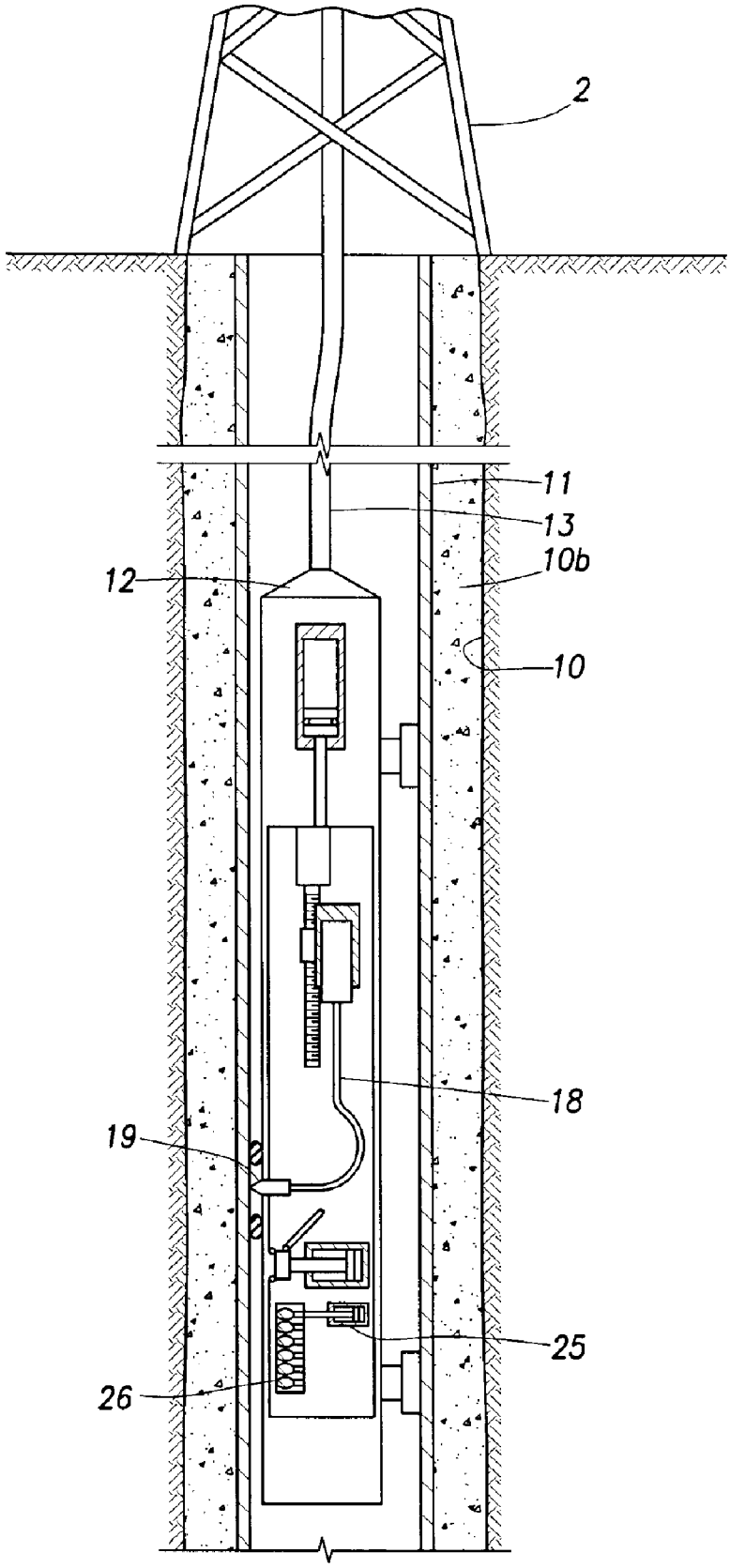
FIG. 1 is a prior art perforating and plugging tool.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

Referring now to FIG. 1, a prior art downhole tool 12 is depicted. The downhole tool of FIG. 1 is described in U.S. Pat. No. 5,692,565, the entire contents of which is hereby incorporated by reference. The downhole tool 12 is deployed into the wellbore 10 from a rig 2 by wireline 13. The wellbore 10 is lined with a casing 11 supported by cement 10*b*. The tool has a drill bit 19 that is advanced through the sidewall of the wellbore via rotating drive shaft 18. The tool 12 is also provided with a plugging mechanism 25 for advancing plugs 26 into perforations created by the drill bit 19.

Figure 2:
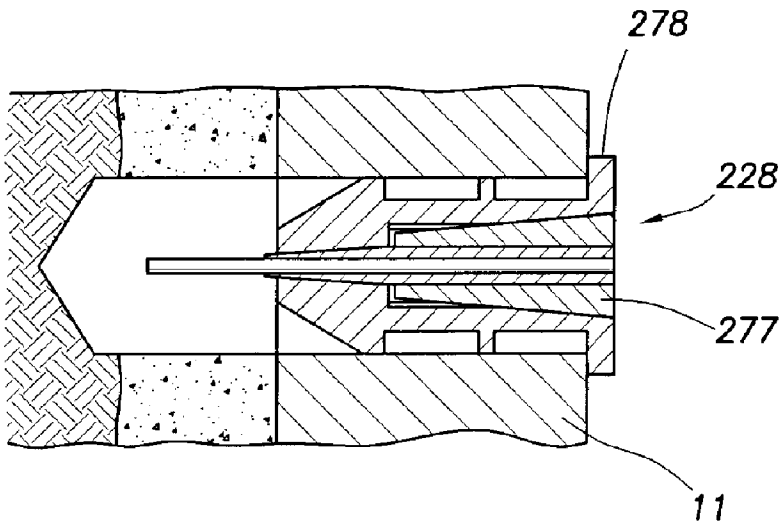
FIG. 2 is a prior art plug positioned in a casing.

FIG. 2 depicts an antenna 228 positioned in a perforated casing 11 using, for example, the tool of FIG. 1. The antenna is described more fully in U.S. Pat. No. 6,766,854, the entire contents of which is hereby incorporated. The antenna is provided with a body 278 and a tapered insert 277.

Figure 3:
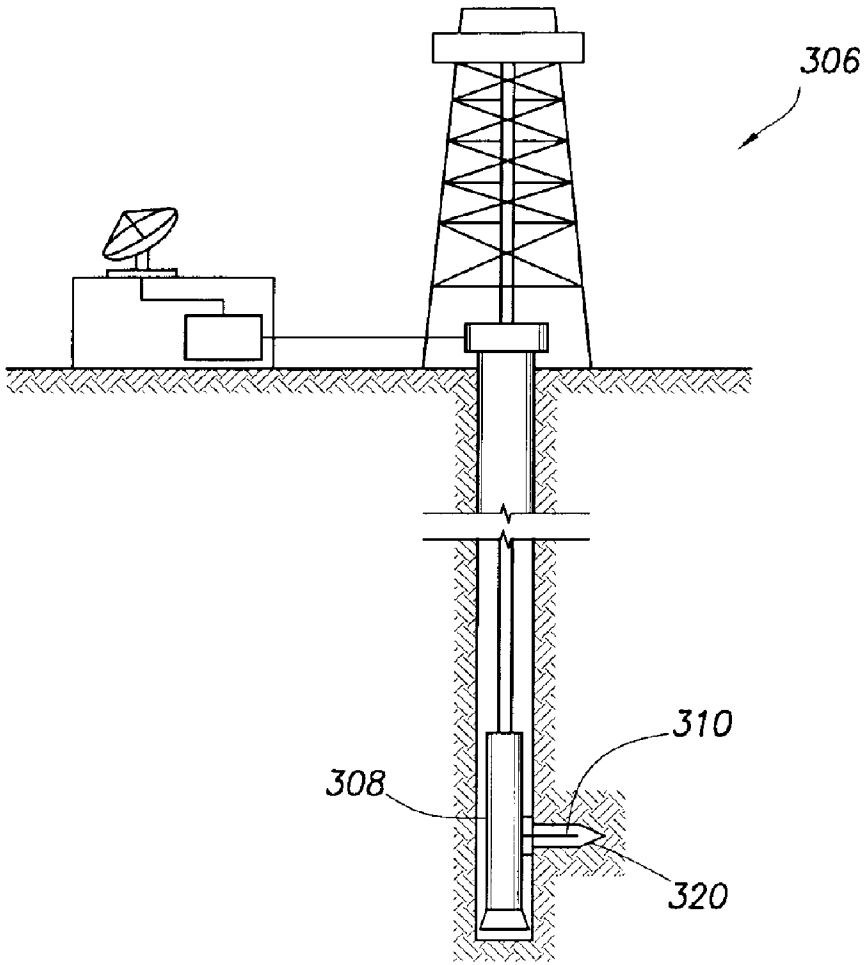
FIG. 3 is a prior art plug positioned in a sidewall of a wellbore and having a sensor disposed therein.

FIG. 3 depicts a system 306 for positioning a sensor plug 320 in a sidewall of a wellbore by a downhole tool 308. The system 306 and sensor plug 320 are described more fully in U.S. Pat. No. 6,766,854, previously incorporated herein. The sensor plug 320 is provided with an antenna 310 and sensors for measuring downhole properties and/or communicating information.

Additional details concerning the items in FIGS. 1-3 are available in U.S. Pat. Nos. 5,692,565 and/or 6,766,854, previously incorporated herein.

Figure 4A:
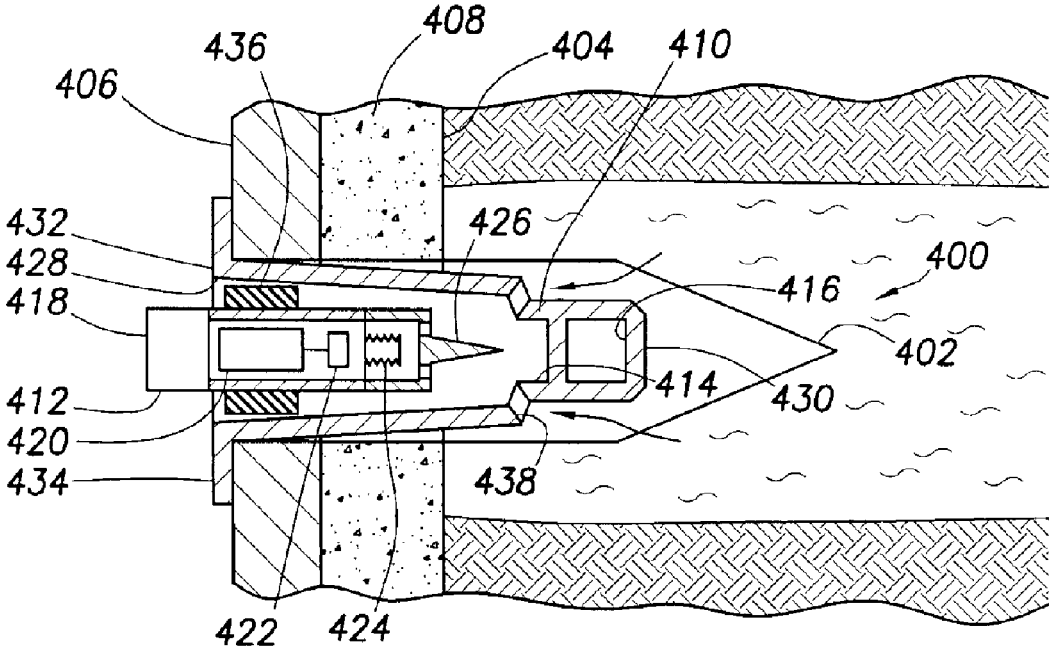
FIG. 4A is schematic view of a sensor plug with a sleeve and a pin positioned in a sidewall of a wellbore in the preloaded position, the pin having electronics therein and the sleeve having a gas chamber therein.
Figure 4B:
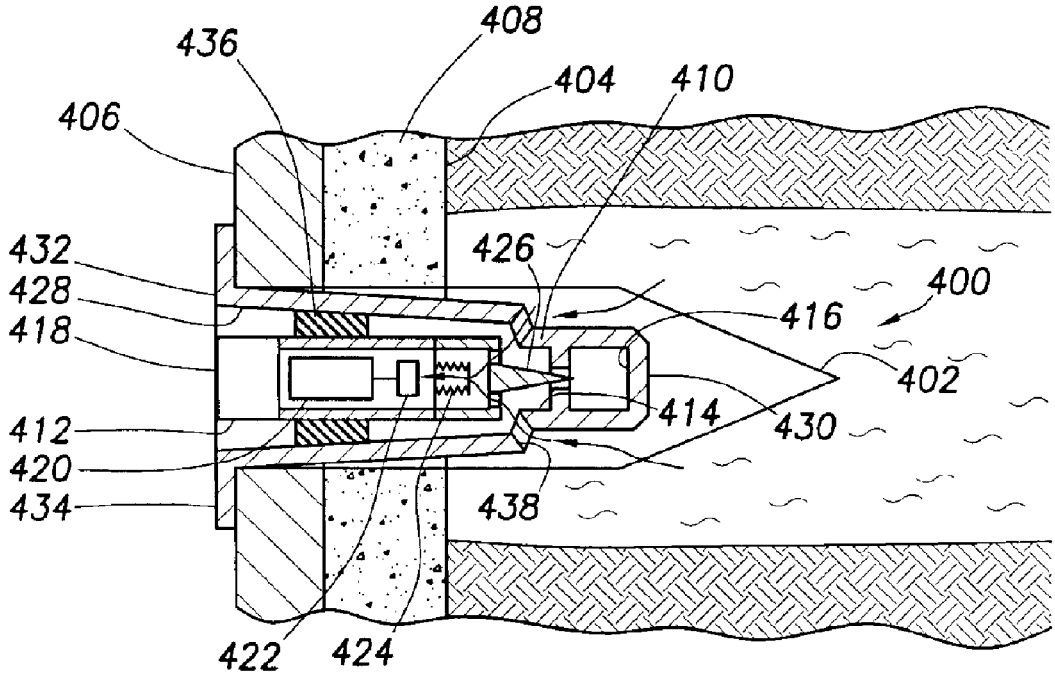
FIG. 4B shows the sensor plug 4A in the loaded position.

FIGS. 4A and 4B depicts sensor plugs 400 positioned in a sidewall of the wellbore. Sensor plug 400 is positioned in a perforation 402 extending through a sidewall 404 of a wellbore having a casing 406 and cement 408. The sensor plug 400 of FIG. 4A is in the pre-loaded position, and the sensor plug 400 of FIG. 4B is in the loaded position. The sensor plug may be inserted into a perforation using perforation and plugging techniques, such as those described in U.S. Pat. Nos. 5,692,565 and/or 6,766,854, previously incorporated herein.

The sensor plug 400 includes an outer body portion (or plug sleeve) 410 and an electronics component or pin 412. The outer body portion 410 has a receptacle 414 for receiving the electronics component 412, and a chamber 416. The electronics component 412 includes a communication coil 418, electronics 420, sensor 422, bellows 424 and a needle 426. The electronics component is preferably positionable in receptacle 414 such that that the communication coil is adjacent an opening 428 of the receptacle. The electronics component is also preferably advanced into the receptacle with the needle 426 at a leading end thereof.

The electronics component preferably contains clean oil sealed behind the bellows 424. The bellows 424 separates the clean oil from the formation fluids while at the same time transmitting the pressure. The pressure in perforation 402 is transmitted through ports 438 extending through the body portion and into the receptacle 424.

The outer body portion is preferably cylindrical with a tapered leading end 430, and has opening 428 at an opposite trailing end 432 thereof. The chamber 416 is positioned near the leading end 430. The outer body portion is preferably provided with a flange 434 at the trailing end 432. The flange 434 acts as a mechanical stop to prevent the body portion from advancing into the formation beyond the wellbore wall and/or casing (if present).

As shown in FIG. 4B, the sensor plug 400 is the same as shown in FIG. 4A, except the electronics package 412 is advanced into the body portion 410. In this view, the sensor plug 400 is in the loaded position with the needle 426 penetrating the chamber 416.

The chamber 416 is preferably an atmospheric chamber. However, any gas may be used, such as a nitrogen or other charged gas. Alternatively, the chamber may also be a vacuum chamber. When the plug is installed and the chamber 416 breached, the volume of fluid in communication with the formation is increased minutely, thus creating a small pre-test, or drop in formation pressure. Pretest are conventional pressure curves performed to determine various formation properties. Examples of pretests are described, in U.S. Pat. No. 5,233,866, the entire contents of which is hereby incorporated by reference.

With the atmospheric chamber activated, the sensor plug may be monitored (periodically or continuously) to observe pressure changes that occur as formation pressure equalizes with pressure in the perforation and/or receptacle. This change in pressure is typically a pressure buildup that resolves the approximate permeability of the formation. The ability to perform such a pressure analysis and/or pretest may be used in even low porosity formations to enable measurement thereof. Moreover, the use of multiple plugs permits correlation of data across plugs in various wells and/or positions in a given well.

When the sensor plug is installed and the needle 426 is pressed in place, the electronics component is advanced into the body and forces the body to form a seal with the casing. The electronics component also has a sleeve 436 that forms a seal along the inside of the body. Once the electronics component is advanced into place and the seal is made, the needle breaches the atmospheric chamber. When this happens, the pressure between the receptacle and the formation will drop as the connected fluid volume increases.

Over time, the formation will respond to the pressure change and produce fluid until the pressure in the perforation 402 is equal to the pressure of the fluid in the formation. The pressure in the perforation is transmitted through the ports 438, into the receptacle 414, to bellows 424 and finally to the sensor 422 as shown by the arrows. Because the volume of fluid to be produced by the formation is only the size of the small atmospheric chamber within the plug, the build up time should be orders of magnitude shorter than with a traditional pressure measurement tool.

Figure 5:
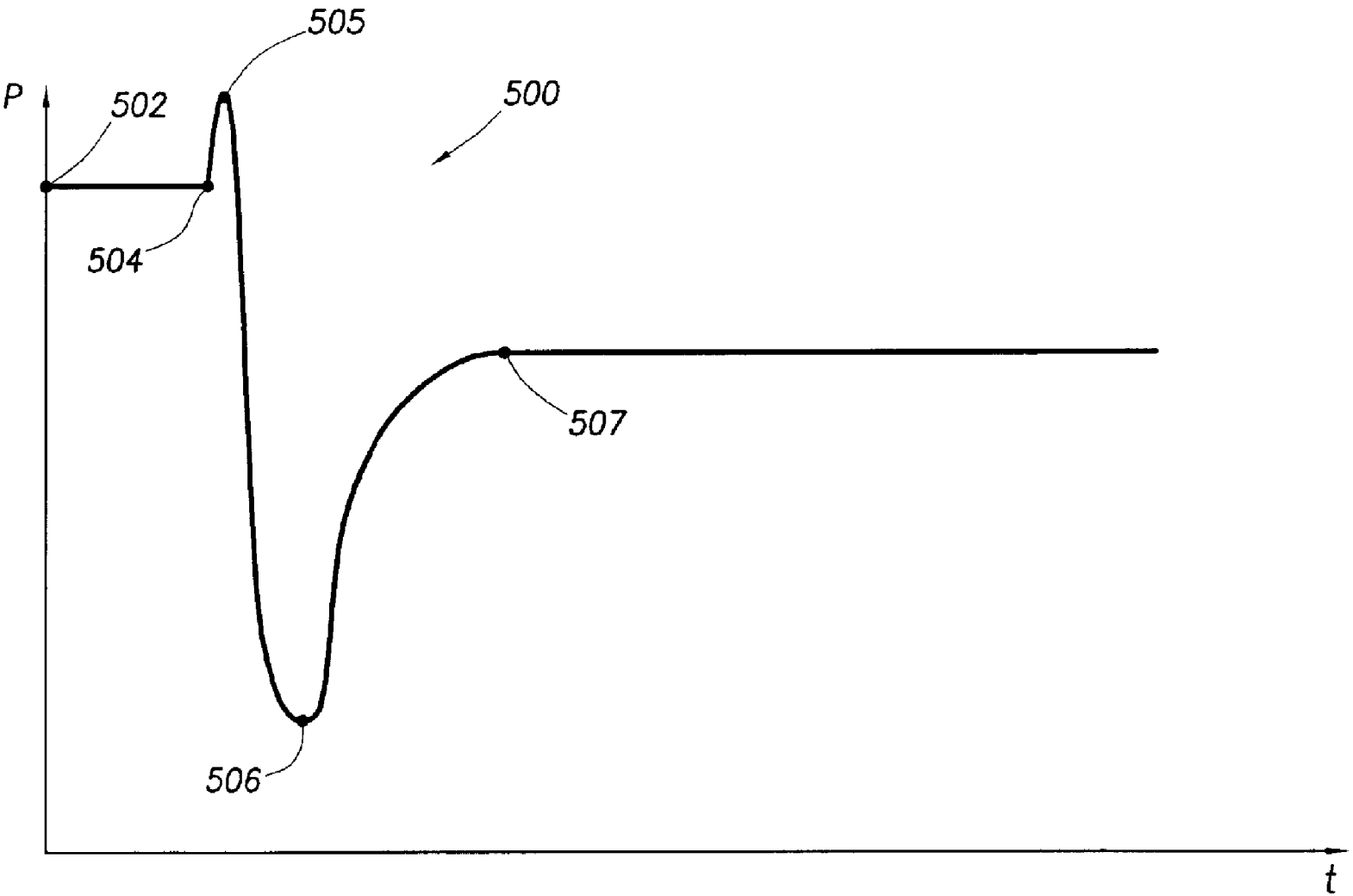
FIG. 5 is graph of pressure versus time for the sensor plug of FIG. 4A.

An expected pressure P (y-axis) versus time t (x-axis) response 500 of the plug installation is shown in FIG. 5. At point 502, the pressure measured by sensor 422 (FIG. 4A) is at borehole pressure. At point 504, the electronics component 412 is advanced into the outer body portion. At point 505, needle 426 breaches atmospheric chamber 416 (FIG. 4B). Pressure falls until it bottoms out at point 506. At point 506, the formation responds to the loss of pressure and begins to equalize with the pressure in the perforation. The pressure increases up to point 507 where it reaches formation pressure.

This operation depicted by the graph of FIG. 5 may be used to simulate a conventional pretest. The drawdown and buildup that occurs from points 505 to 506 and from 506 to 507, respectively, may be analyzed to determine properties of the formation. This 'mini-pretest' may be used to determine a variety of formation parameters.

The sensor plug may also be provided with communication circuitry. Such circuitry preferably permits the sensor plug to monitor various downhole parameters. For example, the sensor plug may monitor pressure transients and watch the pressure begin to build back to formation pressure.

The pre-test can be tuned to a particular formation by varying the depth of the drilled hole or the initial parameters of the atmospheric chamber. The depth of the drilled hole could be varied to change the magnitude of the draw down of formation pressure for a given formation permeability. The larger the hole depth, the greater the initial volume in connection with the formation and the smaller the drawdown will be due the smaller percent change in volume when the atmospheric chamber is breached. Additionally, hole depth controls the area of producing formation. Deeper holes expose more fluid production area, and thus further reduce build up times in very low perm formations.

Variations of the sensor plug may be provided to also tune the measurement for a particular situation or formation. For example, the size of the atmospheric chamber could be larger or smaller to change the initial drawdown of formation pressure. Additionally, the sensor plug could be provided with a pre-charged volume rather than an atmospheric chamber. A gas could be charged in this volume to a pre-determined pressure to tune further the amount of pressure drawdown.

While the sensors described herein relate to pressure measurement, any formation fluid property sensor may be measured. Additionally, the sensor plug may be installed in a drilled hole or an existing perforation, or pressed directly into the formation. The sensor plug may be inserted into the sidewall of an open or cased wellbore. Additionally, the sensor plugs described herein increase the volume of fluid in connection with the formation as the sensor plug is installed, thus decreasing the fluid pressure. Alternatively, the volume in connection between the plug and the formation may be decreased with the installation of the sensor plug. In this situation, the pressure in connection with the formation would be increased.

Figure 6A:
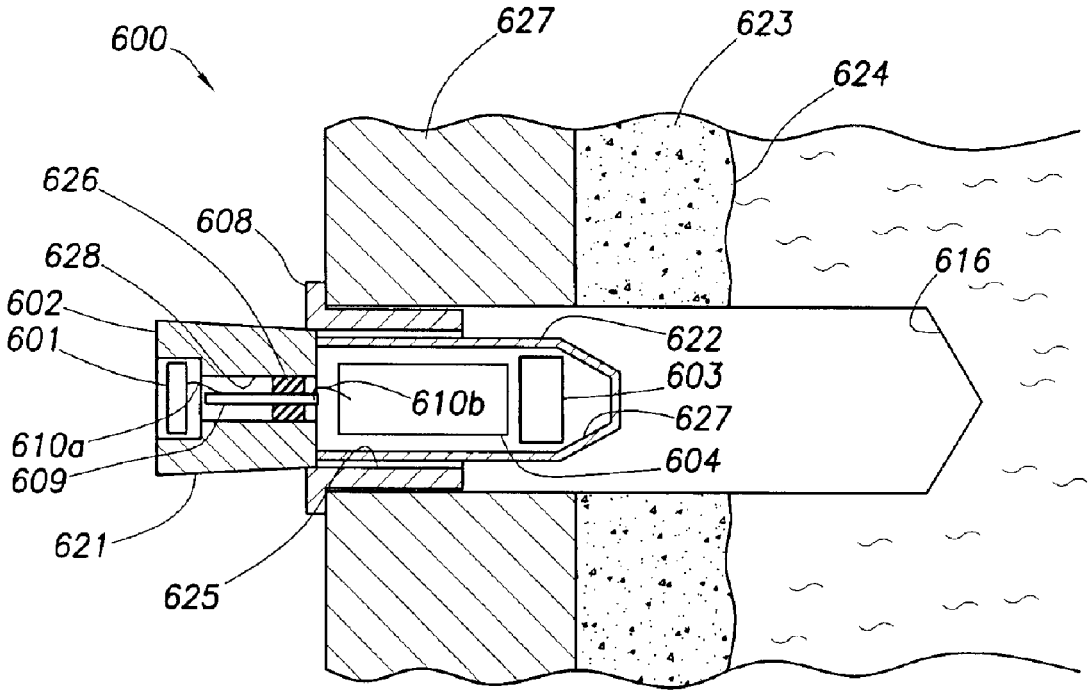
FIG. 6A is a schematic view of an alternate sensor plug with a sleeve and pin positioned in a sidewall of a cased wellbore in the preloaded position, the sleeve having an aperture therethrough for receiving the pin.
Figure 6B:
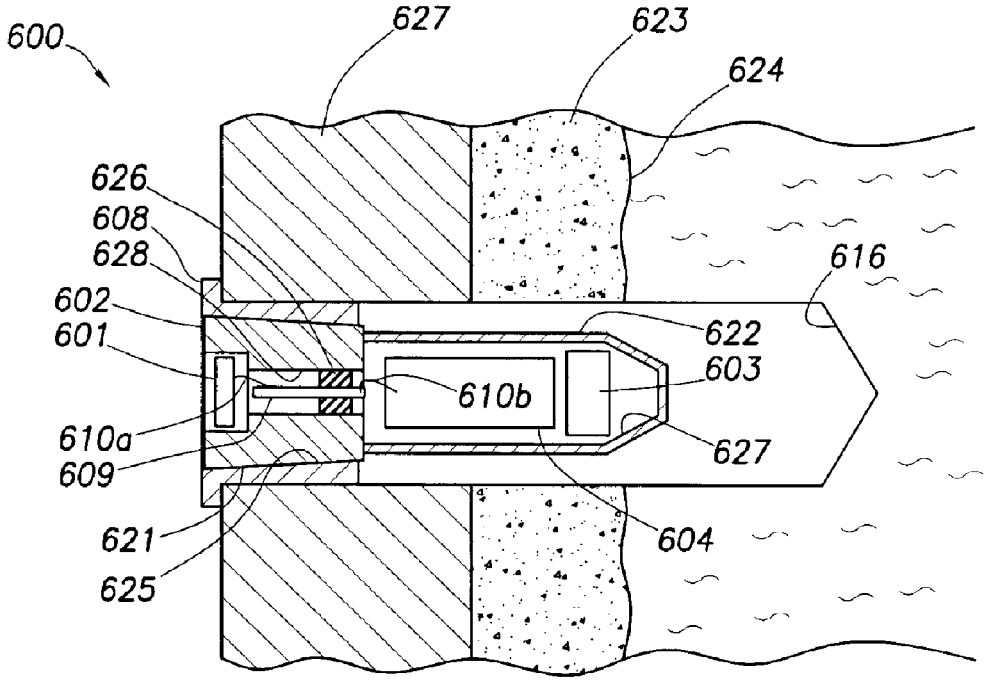
FIG. 6B shows the sensor plug of FIG. 6A in the loaded position.

FIGS. 6A and 6B depict another sensor plug 600 positioned in a perforation 616 in a sidewall of the wellbore 624 lined with cement 623 and a casing 627. FIG. 6A shows sensor plug 600 in the preloaded position, and FIG. 6B shows sensor plug 600 in the loaded position. The sensor plug may be inserted into a perforation using perforation and plugging techniques, such as those described in U.S. Pat. Nos. 5,692,565 and/or 6,766,854, previously incorporated herein.

The sensor plug 600 includes a plug sleeve 608 having an aperture 625 therethrough adapted to receive a pin 602. The plug sleeve is adapted for insertion in the perforation 616 and adjacent the casing 627. The pin 602 includes an antenna portion 621 and an electronics portion 622.

A sensor 603 and associated electronics 604 are positioned in an electronics chamber 627 in the electronics portion 622 of the pin 602. An antenna 601 is positioned in a pin chamber 628 in pin 602. The antenna is adapted to communicate with a receiver, for example, in a tool in the borehole.

A feedthrough 626 is positioned in the pin chamber 628 to isolate the electronics chamber 627 in the electronics portion 622 from the pin chamber 628 of the pin. Feedthrough 626 is preferably an electrical feedthrough that enables communication between the electronics 604 and the antenna 603 while protecting the electronics from the fluids in the borehole.

A conductor 609 extends from the antenna 601 through the feedthrough 626 to provide means for electrically connecting items in chambers 627 and 628. Conductor 609 is electrically connected to the antenna 601 and electronics 604. A first connection 610*a* is used to connect the conductor 609 to antenna 601. A second connection 610*b* is used to connect the conductor 609 to electronics 604. The connections 610 may be a spring, linkage or other mechanism adapted to provide the required electrical connection.

In operation, the plug sleeve 608 is inserted into a perforation 616 as shown in FIG. 6A. Pin 602 is advanced into aperture 625 as shown in FIG. 6B. As the pin is advanced, the sleeve portion 621 is expanded to sealingly engage the casing 627. Before, during or after the insertion and expansion process, the sensor and electronics may be used to measure downhole parameters. The antenna may also be used during this time to communicate with other components. In this manner, signals may be sent to the sensor plug, data may be collected by the sensors and transmitted to a receiver uphole via the antenna. Various processes may be performed for data collection and analysis.

Figure 7A:
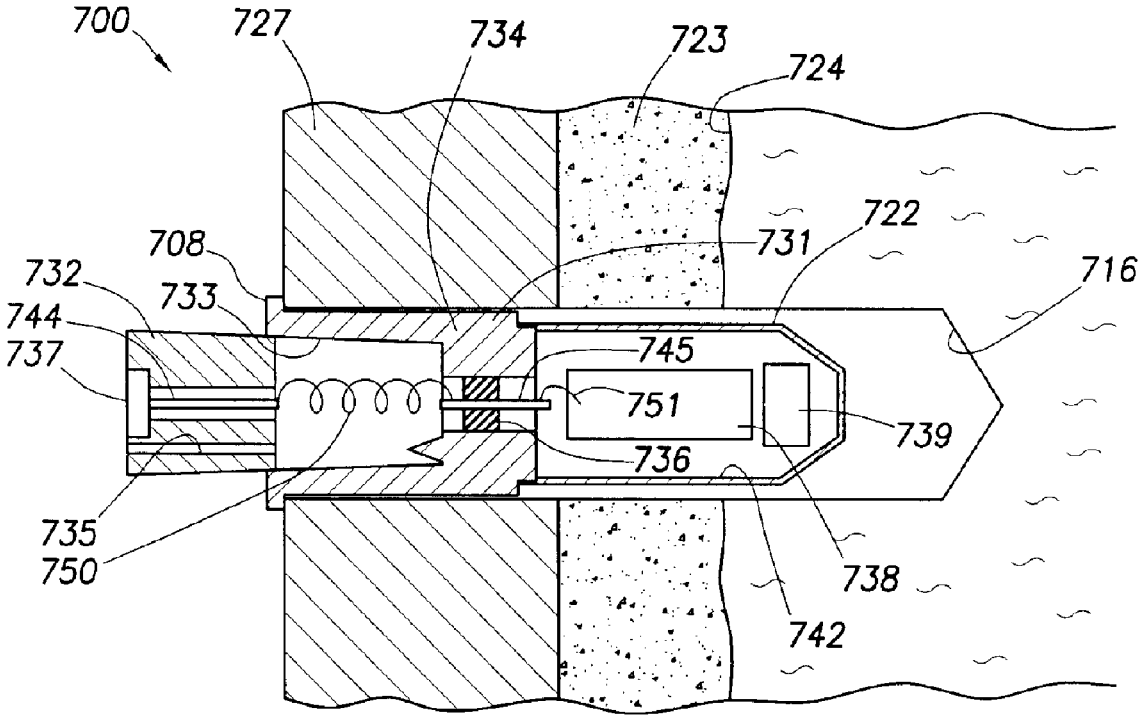
FIG. 7A is a schematic view of an alternate sensor plug with a sleeve and pin positioned in a sidewall of a cased wellbore in the preloaded position, the sleeve having electronics therein.
Figure 7B:
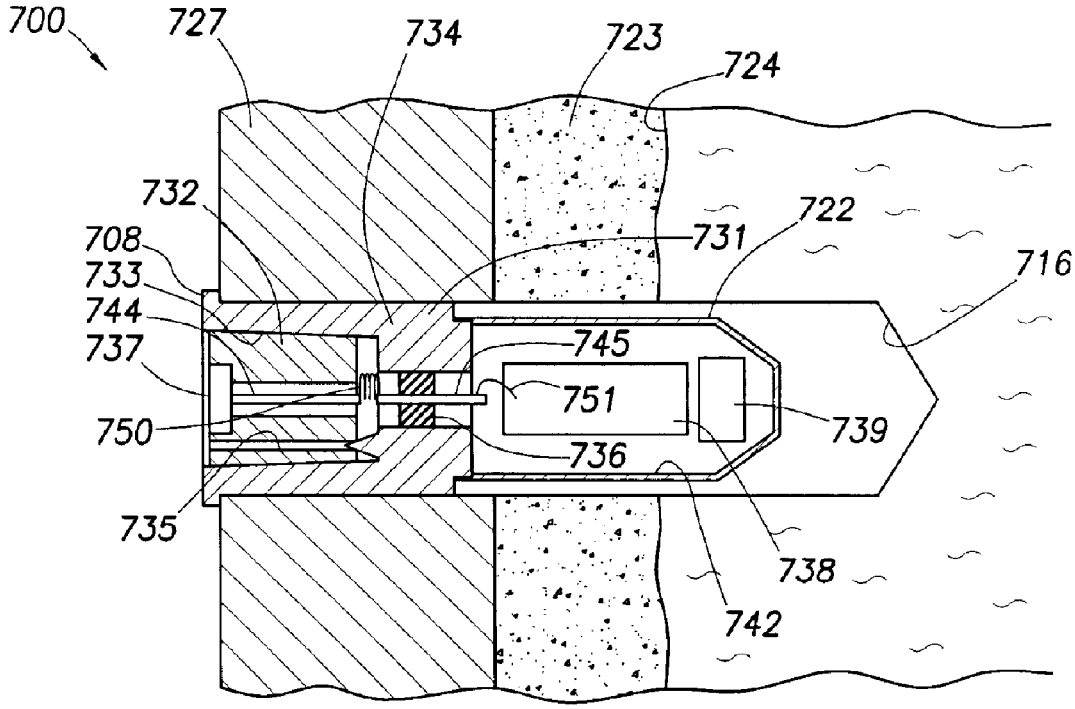
FIG. 7B shows the sensor plug of FIG. 7A in the loaded position.

Referring now to FIGS. 7A-7B, another sensor plug 700 is depicted. These Figures depict sensor plug 700 positioned in a perforation 716 in a sidewall of the wellbore 724 lined with cement 723 and a casing 727. FIG. 7A shows sensor plug 700 in the preloaded position. FIG. 7B shows sensor plug 700 in the loaded position. In this embodiment, the sensor plug 700 includes a plug sleeve 731 and a pin 732.

The plug sleeve includes an electronics portion 722 and a pin receiving portion 734. The electronics portion 722 is preferably integral with or connected to the pin receiving portion 734, for example by welding. A passage 735 extends through pin 732 to permit the flow of fluid therethrough. The sleeve 731 has a cavity 733 therein adapted to receive the pin 732. The sleeve 731 is positionable into the perforation 716. The pin 732 may be advanced into cavity 733 in the sleeve 731. As the pin 732 advances into the sleeve, the sleeve expands and sealingly engages the casing 727 and the pin 732.

Electronics 738 and a sensor 739 are positioned in an electronics chamber 742 in the electronics portion 722. A feedthrough 736 is positioned in cavity 733 in the sleeve and isolates the cavity 733 from the electronics chamber 742 in the electronics portion 722. Feedthrough 736 may be an electrical feedthrough like the feedthrough 626 of FIGS. 6A-6B. In this embodiment, the feedthrough seals the electronics chamber 742 from the borehole fluids that may enter cavity 733.

An antenna 737 is positioned in pin 732 and adapted to communicate with a receiver, for example, in a tool in the borehole. The antenna 737 is connected to a first conductor 744. A second conductor 745 positioned in the feedthrough 736 in sleeve 731. A first connection 750 electrically connects the first and second conductors. A second connection 751 electrically connects the second conductor 745 to the electronics 738. The connections may be a wire, spring, linkage or other mechanism adapted to provide the required electrical connection. Preferably, the connection allows the relative movement of the pin with respect to sleeve.

In operation, sleeve 731 is positioned in perforation 716 as shown in FIG. 7A. Plug 732 is positioned in cavity 733 of the sleeve. Pin 732 is advanced into sleeve 731 as shown in FIG. 7B. As the pin advances into the sleeve, the sleeve is expanded and seals against an inner surface of the perforation 716. The compressive forces due to the interference between the pin 732, sleeve 731 and casing 727 assist in forming a seal at the interface between the pin and the sleeve. This additional force may assist in allowing the sensor plug to withstand a differential pressure between the wellbore and the formation on either side of the casing 716. The sensors may then sense downhole parameters and communicate such information via antenna 737.

The sensor plugs, pins and sleeves of FIGS. 6A-7B are preferably tapered to facilitate advancement into the perforation 716. Additionally, the plug sleeves may be provided with flanges, such as flange 735 of FIGS. 7A-7B, to limit the advancement of the sensor plug into the perforation.

Various portions of the sensor plug may be made of a corrosion resistant alloy, but could also be made of a high strength polymer, depending on the differential pressure rating between the inside and outside of the casing required by the application. Grooves may be machined on the sealing surfaces of the sensor plug, such as sleeve 731, to improve the strength and pressure rating of the sleeve/casing seal. These grooves may also be used to improve the strength and pressure rating of the pin/sleeve seal.

One or several electrical feedthroughs and/or connectors may be used. The electrical feedthroughs may be insulated by a glass, ceramic, polymer or other insulator. The antenna and electrical feedthrough may be electrically insulated from the borehole fluids by overmoulding with an insulating material. The antenna and electrical feedthrough may be protected from the borehole fluids by a corrosion resistant metal, ceramic or polymer membrane or window.

The antenna may be replaced by any other wireless communication device, such as an ultrasonic transducer. Portions of the sensor plug are preferably welded together. The electronics and sensor may be in vacuum in the sensor plug, or immersed in air, or in an inert gas, or in an insulating fluid, at low pressure, or at formation pressure.

A processor may be provided to analyze the data collected by the sensor plug. The processor may be provided in the sensor plug, or in a downhole tool or surface unit in communication with the sensor plug. The data collected by the sensor plug may be combined with other wellsite data to analyze wellsite operations.

The sensor may be sensitive to any of, but not limited to, the following formation parameters: pressure, temperature, resistivity, conductivity, seismic or sonic vibrations, stress or strain, pH, chemical composition as well as a variety of downhole parameters. The sensor 639 may be replaced or complemented by an active device, generating signals to be measured by other sensors, such as currents, electromagnetic waves, sound. The sensor and its electronics may be powered by a battery, or remotely by the interrogation tool in the borehole. Additionally, power may be supplied to the electronics and/or sensor via the antenna.

The details of certain arrangements and components of the plug(s) and associated system described above, as well as alternatives for such arrangements and components would be known to persons skilled in the art and found in various other patents and printed publications, such as, those discussed herein. Moreover, the particular arrangement and components of the sensor plug(s) may vary depending upon factors in each particular design, or use, situation. Thus, neither the sensor plug nor the present invention are limited to the above described arrangements and components, and may include any suitable components and arrangement. For example, various sensor plugs may be positioned in cased or uncased wellbores in a variety of configurations. Similarly, the arrangement and components of the sensor plug may vary depending upon factors in each particular design, or use, situation. The above description of exemplary components and environments of the tool with which the probe assembly and other aspects of the present invention may be used is provided for illustrative purposes only and is not limiting upon the present invention.

The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A sensor plug positionable in a perforation extending into a wall of a wellbore penetrating a subterranean formation, comprising:

a plug sleeve disposable in a perforation extending through the wellbore wall;

a pin positionable in the plug sleeve, the pin adapted to expand the plug sleeve as it is advanced therein whereby the plug sleeve seals the perforation, wherein at least one of the plug sleeve and the pin have ports therein for passing fluid therethrough;

a sensor for measuring downhole properties; and circuitry operatively connected to the sensor.

2. The sensor plug of claim 1, wherein the plug sleeve has a cavity therein for receiving the pin.

3. The sensor plug of claim 1, wherein the plug sleeve has an aperture extending therethrough for receiving the pin.

4. The sensor plug of claim 1 wherein the sensor and circuitry are positioned in the plug sleeve.

5. The sensor plug of claim 1 wherein the sensor and circuitry are positioned in the pin.

6. The sensor plug of claim 1, wherein the plug sleeve has a chamber therein, and the pin has a needle at an end Thereof adapted to breach the chamber when the pin is advanced into the sleeve.

7. The sensor plug of claim 6 wherein the chamber has a gas therein.

8. The sensor plug of claim 1 further comprising a pin sleeve positioned between the pin and the plug sleeve for forming a seal therebetween.

9. The sensor plug of claim 1, wherein the plug sleeve has a flange at an end thereof to terminate the advancement of the plug sleeve through the perforation.

10. The sensor plug of claim 1 further comprising a bellows operatively connected to at least one of the sensor and circuitry for isolation thereof from contact with a downhole fluid while permitting a pressure of the downhole fluid to be applied thereto.

11. The sensor plug of claim 1, further comprising an antenna for sending and receiving signals.

12. The sensor plug of claim 11, wherein the antenna is positioned in the pin.

13. The sensor plug of claim 11, further comprising at least one conductor for operatively connecting the antenna with the sensor.

14. The sensor plug of claim 11, further comprising at least one electrical connection for operatively connedting the at least one conductor to one of the antenna, the sensor, the circuitry and combinations thereof.

15. The sensor plug of claim 11, further comprising a feedthrough positioned in one of the pin and the plug sleeve for fluidly isolating the sensor and the circuitry from downhole fluids.

16. A method of sensing downhole parameters of a wellbore penetrating a subterranean formation, comprising:

positioning a plug sleeve in a perforation in a sidewall of the wellbore;

sealing the perforation by advancing a pin into the plug sleeve;

providing fluid communication into an interior of the plug sleeve; and sensing at least one downhole parameter from a sensor positioned in one of the sleeve and the pin.

17. The method of claim 16, further comprising creating a perforation in a sidewall of the wellbore.

18. The method of claim 16, further comprising performing a pretest.

19. The method of claim 18, wherein the step of performing a pretest comprises breaching a chamber in the plug sleeve by advancing a needle operatively connected to the pin and sensing the downhole parameters.

20. The method of claim 19, further comprising tuning a gas in the chamber to the formation.

21. The method of claim 19, further comprising tuning the pretest to a depth of the perforation.

22. The method of claim 16 wherein the step of sensing comprising measuring a downhole pressure of a fluid adjacent the sensor.

23. The method of claim 16 further comprising analyzing the at least one downhole parameter.

24. A communication system for sensing downhole parameters of a wellbore penetrating a subterranean formation, comprising:

a sensor plug positionable in a perforation extending into the wall of the wellbore, comprising:

a plug sleeve disposable in a perforation extending through the wellbore wall;

a pin positionable in the plug sleeve, the pin adapted to expand the plug sleeve as it is advanced therein whereby the plug sleeve seals the perforation;

a port disposed in at least one of the plug sleeve and the pin for passing fluid therethrough;

a sensor for measuring downhole properties; and circuitry operatively connected to the sensor, a downhole tool positionable in the wellbore, the downhole tool adapted to communicate with the sensor plug; and a surface unit in communication with the downhole tool.

25. The communication system of claim 24, wherein the downhole tool comprises a perforator for creating the perforation.

26. The communication system of claim 24, wherein the downhole tool is one of a wireline tool, drilling toot, coiled tubing tool and combinations thereof.

* * * * *